US010218053B2

(12) United States Patent
Tsai et al.

(10) Patent No.: US 10,218,053 B2
(45) Date of Patent: Feb. 26, 2019

(54) ANTENNA DEVICE

(71) Applicant: HTC CORPORATION, Taoyuan (TW)

(72) Inventors: Tiao-Hsing Tsai, Taoyuan (TW); Chien-Pin Chiu, Taoyuan (TW); Hsiao-Wei Wu, Taoyuan (TW); Li-Yuan Fang, Taoyuan (TW); Yi-Hsiang Kung, Taoyuan (TW)

(73) Assignee: HTC CORPORATION, Taoyuan (TW)

( * ) Notice: Subject to any disclaimer, the term of this patent is extended or adjusted under 35 U.S.C. 154(b) by 321 days.

(21) Appl. No.: 14/854,531

(22) Filed: Sep. 15, 2015

(65) Prior Publication Data

US 2017/0077592 A1 Mar. 16, 2017

(51) Int. Cl.

| | |
|---|---|
| ***H01Q 1/24*** | (2006.01) |
| ***H01Q 1/48*** | (2006.01) |
| ***H01Q 5/50*** | (2015.01) |
| ***H01Q 5/392*** | (2015.01) |

(52) U.S. Cl.
CPC ..... *H01Q 1/243* (2013.01); *H01Q 5/392* (2015.01); *H01Q 5/50* (2015.01)

(58) Field of Classification Search
CPC ..... H01Q 1/243
See application file for complete search history.

(56) References Cited

U.S. PATENT DOCUMENTS

| | | | | |
|---|---|---|---|---|
| 8,836,582 | B2 * | 9/2014 | Wong | H01Q 1/243 343/700 MS |
| 2014/0210675 | A1 * | 7/2014 | Hwang | H01Q 1/44 343/702 |

FOREIGN PATENT DOCUMENTS

| | | | |
|---|---|---|---|
| CN | 1809947 | A | 7/2006 |
| CN | 103682587 | A | 3/2014 |
| TW | 201114101 | A | 4/2011 |
| TW | 201234709 | A1 | 8/2012 |

(Continued)

OTHER PUBLICATIONS

TW Summary of the Rejection Decision for Application No. 105104477; dated Apr. 11, 2017.

(Continued)

*Primary Examiner* — Jessica Han
*Assistant Examiner* — Amal Patel
(74) *Attorney, Agent, or Firm* — Cantor Colburn LLP

(57) ABSTRACT

An antenna device, including a circuit board, electronic components, a functional component module, an antenna module and a feed line, is provided. The electronic components are disposed on the circuit board and include a microprocessor and a wireless communication chip. The functional component module includes a carrier and a metal member disposed on the carrier. The antenna module includes a feed point, a ground point and a radiator, the feed and ground points are disposed on the carrier and electrically connected to both sides of the metal member respectively, and the ground point is electrically connected to the ground layer of the circuit board. The radiator includes at least a part of the metal member, while the feed line can transmit a wireless signal to the feed point to feed into the radiator. Therefore, the metal member can serve as the radiator to conserve the space of accommodating another radiator.

19 Claims, 12 Drawing Sheets

(56) References Cited

FOREIGN PATENT DOCUMENTS

TW 201236271 A1 9/2012

OTHER PUBLICATIONS

First Office Action corresponding to Tawain Application No. 105104477, dated Jan. 10, 2017; with English summary.
CN Office Action corresponding to CN201610114292.0 dated Dec. 27, 2018.

* cited by examiner

ANTENNA DEVICE

BACKGROUND OF THE INVENTION

Field of the Invention

The present invention provides an antenna device, and more particularly, to an antenna device that integrates an antenna module with a functional component module.

Descriptions of the Related Art

Wireless communication technologies have been widely used in various electronic products. For smartphones or tablet computers, a large number of wireless signal frequencies are used (i.e., a large number of frequency bands are covered), so a large number of antennas would have to be used in such an electronic product to transceive various wireless signals.

However, with the number of antennae, it becomes difficult to distribute the antennae within an electronic product. In particular, it is difficult to arrange the antennae inside the electronic product to obtain a desired efficiency and to prevent the antennae from occupying spaces of other electronic components/modules. In addition, these problems become more complex as the sizes of the electronic products decrease.

Accordingly, a need exists in the art to provide a solution of designing and arranging antennae with desired wireless communication frequencies in a limited and complex space within an electronic product.

SUMMARY OF THE INVENTION

An objective of the present invention is to provide an antenna device capable of integrating an antenna module and a functional component module together to conserve space that is occupied by the antenna module.

Another objective of the present invention is to provide an antenna device capable of providing at least two resonance modes to allow for the operation of the antenna device in at least two frequency bands.

To achieve the aforesaid objectives, an antenna device disclosed in the present invention comprises: a circuit board, comprising a ground layer; a plurality of electronic components, being disposed on the circuit board and including a microprocessor and a wireless communication chip; a functional component module comprising a carrier and a metal member disposed on the carrier, the carrier having a main portion and an extended portion, a side surface of the main portion being spaced apart from and facing toward a side surface of the circuit board, and the extended portion extending from the side surface of the main portion to connect with the side surface of the circuit board; a first antenna module, having a feed point, a first ground point and a first radiator, the feed point being disposed on the main portion and electrically connected to a side of the metal member, the first ground point being disposed on the extended portion and electrically connected to the other side of the metal member and electrically connected to the ground layer, and the first radiator comprising at least a part of the metal member; and a feed line, having one end electrically connected to the feed point and the other end electrically connected to the wireless communication chip, and being adapted to transmit a first wireless signal to the feed point to feed into the first radiator.

To achieve the aforesaid objectives, another antenna device disclosed in the present invention comprises: a circuit board, comprising: a ground layer; a plurality of electronic components, being disposed on the circuit board and including a microprocessor and a wireless communication chip; a functional component module comprising a carrier and a metal member disposed on the carrier, the carrier having a main portion and an extended portion, a side surface of the main portion being spaced apart from and facing toward a side surface of the circuit board, and the extended portion extending from the side surface of the main portion to connect with the side surface of the circuit board; a first antenna module, having a first ground point and a first radiator, the first ground point being disposed on the extended portion and electrically connected to one side of the metal member and electrically connected to the ground layer, and the first radiator comprising at least a part of the metal member; a second antenna module, being disposed above the carrier and having a feed point, a second radiator and a second ground point, the feed point being disposed at one end of the second radiator, and the second ground point being disposed at the other end of the second radiator and electrically connected to the ground layer; and a feed line, having one end electrically connected to the feed point and the other end electrically connected to the wireless communication chip, and being adapted to transmit a first wireless signal to the feed point so as to be coupled to the first radiator and transmit a second wireless signal to the feed point to feed into the second radiator.

Thereby, the antenna device of the present invention has at least the following technical effectiveness: the first antenna module and the functional component module are integrated together so that the functional component module can act as a radiator for the first antenna module to save or eliminate the need of a space for accommodating the radiator. The first antenna module and the second antenna module can be coupled together to produce another resonance mode so that at least two resonance modes can be provided by the antenna device.

The detailed technology and preferred embodiments implemented for the subject invention are described in the following paragraphs accompanying the appended drawings for people skilled in this field to well appreciate the features of the claimed invention.

DESCRIPTION OF THE PREFERRED EMBODIMENT

Figure 1A:
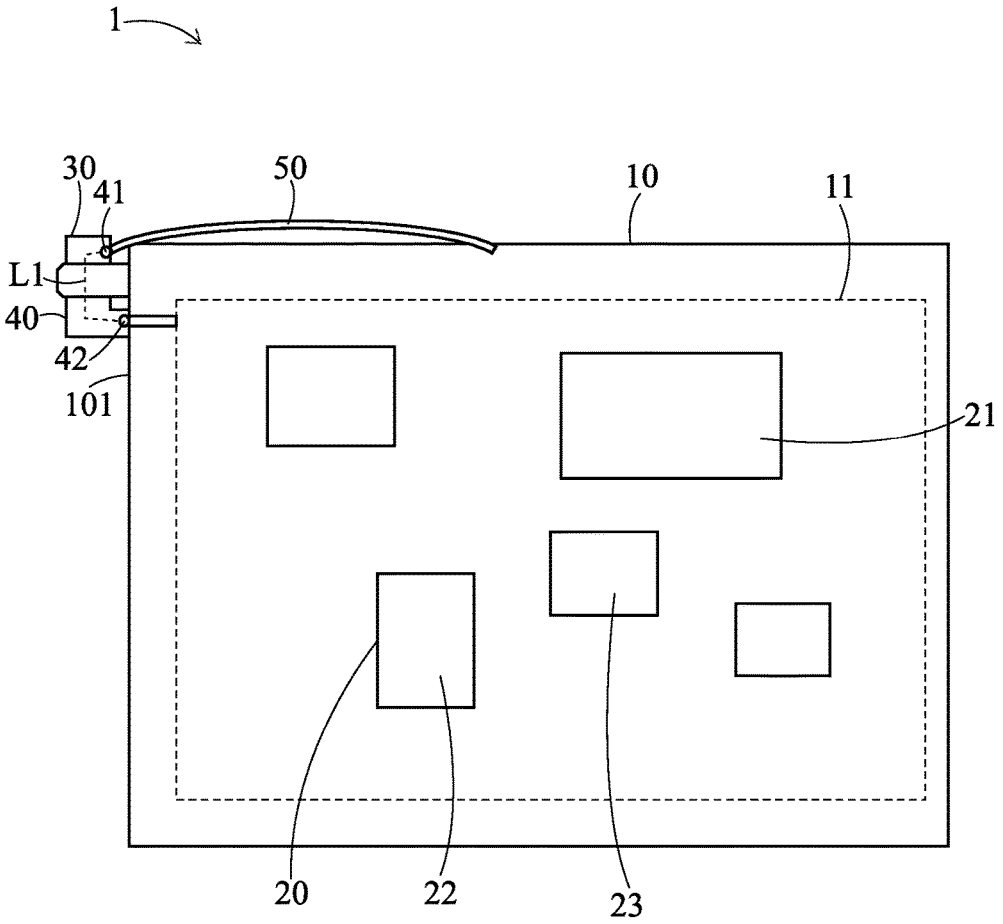
FIG. 1A is a top view of an antenna device according to the first preferred embodiment of the present invention.
Figure 1B:
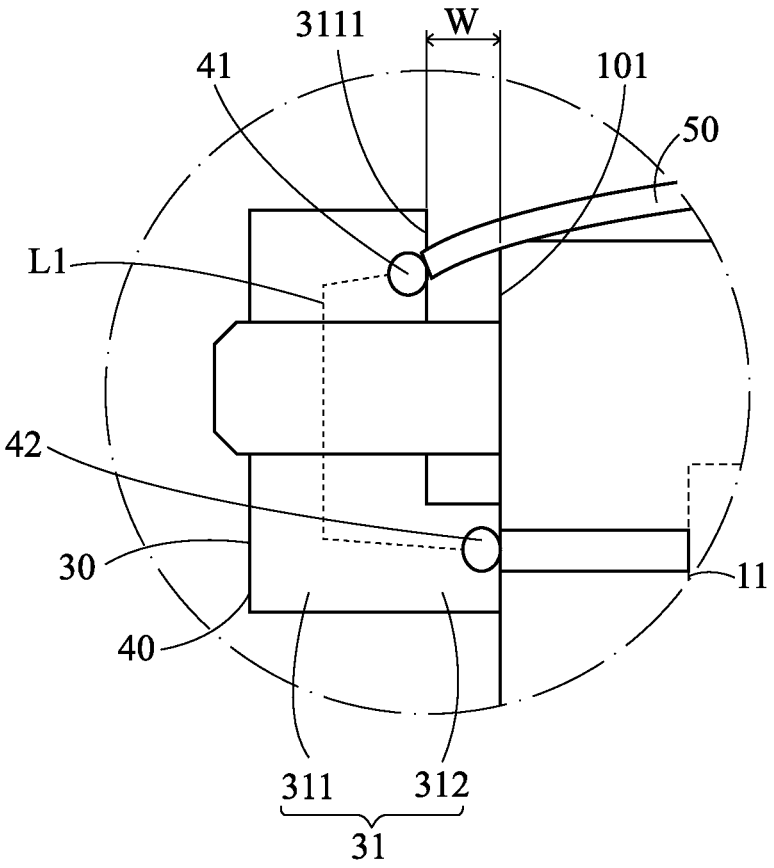
FIG. 1B is a partially enlarged view of FIG. 1A.
Figure 2:
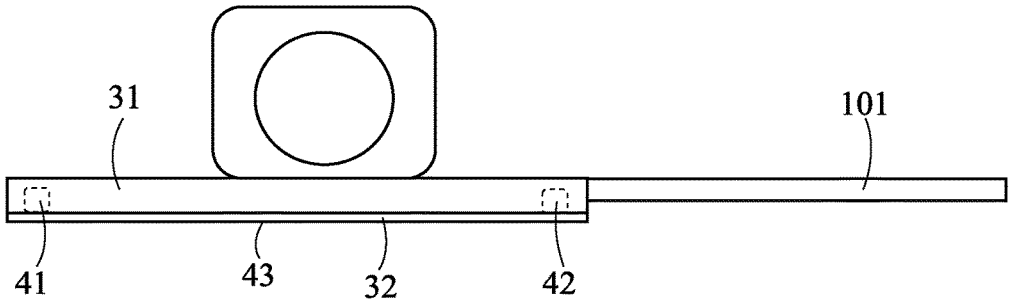
FIG. 2 is a side view of the antenna device according to the preferred embodiment of the present invention.

FIGS. 1A, 1B and 2 show top views and a side view of an antenna device according to the first preferred embodiment respectively. The antenna device 1 may be a part of an electronic product (e.g., a smartphone or a tablet computer) with wireless communication functionality. The antenna device 1 may comprise a circuit board 10, a plurality of electronic components 20, a functional component module 30, a first antenna module 40 and a feed line 50. The technical contents of which will be described in sequence hereinbelow.

As the main circuit board in the electronic product, the circuit board 10 is adapted to support most of electronic components 20 (including main electronic components) thereon, and some mechanical members (not shown) may also be disposed on the circuit board 10. In terms of the outline, the circuit board 10 is schematically illustrated to be in a rectangular form, but in practical applications, the form of the circuit board 10 is not limited thereto and may be an irregular form instead. In terms of the structure, the circuit board 10 comprises a circuit pattern layer (not shown) which allows for direct or indirect electrical interconnection between the electronic components 20 to transmit electric signals therebetween. The circuit board 10 further comprises one or more ground layers 11, which may be an outer layer or an inner layer (i.e., not exposed outside) of the circuit layer 10. The ground layer 11 may be a metal layer, e.g., a copper layer.

The electronic components 20 may be disposed on the circuit board 10, e.g., through soldering or through an electrical connector (not shown), and are electrically connected with the circuit pattern layer and the ground layer 11 of the circuit board 10. The electronic components 20 may comprise a microprocessor 21, a wireless communication chip 22 or the like. The microprocessor 21 (also known as a microcontroller or a central processing unit (CPU), which is configured to execute data operations or the like) and the wireless communication chip 22 (which is configured to transceive and/or process wireless signals, is equivalent to a receiver/a transmitter or a transceiver, and may also be a chipset) are both electronic components commonly used in electronic products with the communication functionality, so specific implementations thereof will be readily appreciated by those of ordinary skill in the art. Additionally, the microprocessor 21 and the wireless communication chip 22 may also be integrated as a single piece on the circuit board 10.

Depending on the practical applications or needs, the electronic components 20 may further include a memory 23, a battery, a liquid crystal (LC) screen, various sensors and/or a signal processing chip or the like (not shown) for providing various functions of the electronic products. Therefore, the circuit board 10 that supports these electronic components 20 may be called a motherboard.

Similar to the electronic components 20 on the circuit board 10, the functional component module 30 is also used to provide functions of the electronic product. Depending on the practical applications or needs, the functional component module 30 may comprise an earphone module, a camera module, a speaker module, a vibration module or a connector module that are commonly used in electronic products. Because the earphone module, the speaker module, the connector module or the like can all be used to output a signal, this kind of functional component module 30 may also be called an output component module. Hereinbelow, the earphone module will be taken as an example for further description.

In terms of the structure, the functional component module 30 may comprise a carrier 31 and a metal member 32, or may also comprise a nonmetal member (e.g., a plastic structure located around the periphery of the earphone socket). The carrier 31 has a main portion 311 and an extended portion 312. The main portion 311 does not make direct contact with or join with the circuit board 10, and instead, the side surface 3111 of the main portion 311 is spaced apart from and faces towards the side surface 101 of the circuit board 10. In other words, spacing W is defined between the side surface 3111 of the main portion 311 and the side surface 101 of the circuit board 10. The carrier 31 may be much smaller in size than the circuit board 10, so the carrier 31 may be called a sub-board. The carrier 31 may also be a flexible circuit board.

Figure 1C:
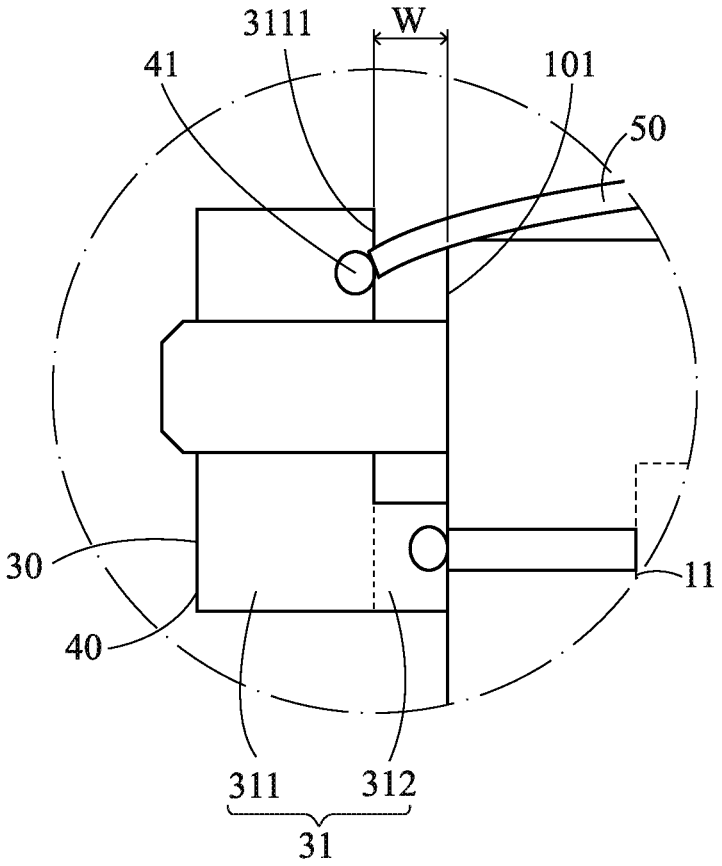
FIG. 1C is another partially enlarged view of FIG. 1A (with the radiation path not being shown therein)

As shown in FIG. 1C, a boundary between the main portion 311 and the extended portion 312 may be schematically shown by an imaginary dashed line. The extended portion 312 extends from the side surface 3111 of the main portion 311 and then makes contact with and joins with the side surface 101 of the circuit board 10. Therefore, the extended portion 312 and the main portion 311 may be formed integrally, and the extended portion 312 is fixed to the side surface 101 of the circuit board 10. The extended portion 312 may also be formed integrally with the circuit board 10, in which case the extended portion 312 and the main portion 311 may be considered to extend out from the side surface 101 of the circuit board 10.

The metal member 32 is disposed on the carrier 31, and generally refers to structures comprising metal conductors on the carrier 31. The metal member 32 may be distributed on the main portion 311 and the extended portion 312. The metal member 32 may, for example, include a metal enclosure, a metal pin, a metal sheet, a metal line, a resistor, a capacitor or an inductor, or the like, and in this embodiment, a metal sheet located at the bottom of the carrier 31 is shown as an example.

It shall be further noted that there is also an electrical connection between the functional component module 30 and the circuit board 10 for transmission of electric signals therebetween. The electric signals may be transmitted to the circuit board 10 via the extended portion 312, so the functional component module 30 may comprise contacts, transmission lines, electrical connectors or the like (not shown) on the extended portion 312 to electrically connect with the circuit board 10. These contacts, transmission lines or electrical connectors may also be considered as possible instances of the metal member 32.

The first antenna module 40 is configured to transceive electromagnetic waves of a specific frequency (frequency band), and comprises a feed point 41, a first ground point 42 and a radiator 43. The feed point 41 is disposed on the main portion 311 of the carrier 31, and is preferably on the side surface 3111 of the main portion 311 and near a corner of the main portion 311. The feed point 41 is also electrically connected to the side of the metal member 32.

The first ground point 42 is disposed on the extended portion 312 of the carrier 31, and is preferably joined with the circuit board 10 near the extended portion 312. The first ground point 42 is also electrically connected to the other side of the metal member 32. In other words, the first ground point 42 and the feed point 41 are located at two sides of the metal member 32. The first ground point 42 is further electrically connected to the ground layer 11 of the circuit board 10, e.g., via a contact, a transmission line or an electrical connector on the extended portion 312.

The first radiator 43 comprises at least a part or the whole of the metal member 32. In other words, the first antenna 40 has the first radiator 43 integrated into the metal member 32 to transceive electromagnetic waves directly via the metal member 32. In this way, the space of the first radiator 43 is additionally saved.

A radiation path L1 may be defined from the feed point 41 through the first radiator 43 (the metal member 32) to the first ground point 42. The length of the radiation path L1 has an effect on the resonance mode (the resonance frequency), and by adjusting the distance between the feed point 41 and the first ground point 42 (i.e., by adjusting positions where the feed point 41 and the first ground point 42 are connected with the metal members 32 on the carrier 31), the length of the radiation path L1 can be changed to obtain a desired resonance mode. Usually, the radiation path L1 may be adjusted by adjusting the size of the carrier 31 (e.g., by adjusting the position where the extended portion 312 extends from the main portion 311). In this embodiment, the operation frequency of the first antenna module 40 may range from 2300 MHz to 2700 MHz.

Additionally, the spacing W between the side surface 3111 of the main portion 311 and the side surface 101 of the circuit board 10 may also be adjusted to adjust the impedance matching of the first radiator 43. The spacing W is preferred to be adjusted within a range of 0.5 mm to 5 mm to obtain the desired impedance matching.

The feed line 50 is configured to transmit a first wireless signal (radio frequency (RF) energy) from the wireless communication chip 22 on the circuit board 10 to the first antenna module 40, and then the first antenna module 40 emits electromagnetic waves according to the first wireless signal. Specifically, the feed line 50 has one end thereof electrically connected to the feed point 41 and the other end electrically connected to the circuit board 10 for further the electrical connection with the wireless communication chip 22. The first wireless signal is fed into the feed point 41 and the first radiator 43 via the feed line 50, and then electromagnetic waves are emitted by the first radiator 43. On the other hand, the first radiator 43 may also receive electromagnetic waves, which are then transmitted to the wireless communication chip 22 via the feed point 41, the feed line 50 and the circuit board 10. The feed line 50 may be in the form of a commonly used feed line such as a cable line, a waveguide, or the like.

As can be known from the above descriptions, the antenna device 1 of this embodiment integrates the first antenna module 40 and the functional component module 30 so that the metal member 32 of the functional component module 30 can be used to transceive electromagnetic waves. Thus, the first antenna module 40 and the functional component module 30 may be accommodated within the same space; in other words, space that would otherwise be needed for accommodating the other can be saved. Additionally, as the metal member 32 is used to transceive electromagnetic waves, electromagnetic waves of a desired frequency can be obtained by adjusting the radiation path L1.

It is noted that inside the functional component module 30, there are not only electric signals (e.g., audio signals) from the functional component module 30 but also wireless signals from the feed line 50. The "metal member 32 for the wireless signals" and the "metal line (another metal member) for the electric signals" may be isolated from each other to reduce interferences between the wireless signals and the electric signals.

Thus, the technical contents of the antenna device 1 have been described. Next, technical contents of antenna devices according to other embodiments of the present invention will be described. Cross references may be made between the technical contents of the individual embodiments, so descriptions of identical parts will be omitted or simplified.

FIGS. 3A, 3B, 4 and 5 show top views and side views of an antenna device according to the second preferred embodiment of the present invention respectively. Similar to the antenna device 1 (as shown in FIG. 1A), the antenna device 2 may also comprise a circuit board 10, electronic components 20, functional component modules 30, a first antenna module 40 and a feed line 50. However, the antenna device 2 further comprises a second antenna module 60 for transceiving electromagnetic waves of another specific frequency.

Specifically, the second antenna module 60 is disposed above the carrier 31 with a spacing H from the carrier 31. The second antenna module 60 has a second radiator 61 and a second ground point 62. The second radiator 61 is a metal conductor (e.g., a metal sheet or a metal line). The second ground point 62 is disposed at the end of the second radiator 61. Additionally, the second ground point 62 is electrically connected also to the ground layer 11 of the circuit board 10. If it is hard to directly connect the second ground point 62 to the circuit 10 due to the large distance therebetween, the second ground point 62 may be electrically connected to the ground layer 11 via a connecting part 63 of the second antenna module 60, e.g., an elastic sheet, a transmission line or a pogo pin.

It is noted that no feed point is provided on the second radiator 61 for direct connection of the feed line 50. A second wireless signal (RF energy) transmitted by the feed line 50 is fed into the second radiator 61 through coupling. That is, the second wireless signal from the wireless communication chip 22 is transmitted by the feed line 50 to the feed point 41 and the first radiator 43 of the first antenna module 40. Then, through a coupling effect, a specific resonance mode is excited in the second radiator 61 to emit electromagnetic waves of a specific frequency.

The resonance frequency of the second radiator 61 is associated with the radiation path L2 which, in turn, is associated with the second ground point 62 and the feed point 41 therebeneath, so the length of the radiation path L2 can be changed by adjusting the positions of the second ground point 62 and the feed point 41. In this embodiment, the operation frequency of the second antenna module 60 may range between 1805 MHz and 2170 MHz. Additionally, the spacing H between the second antenna module 60 (the second radiator 61) and the carrier 31 may be adjusted depending on the needs to change the impedance matching of the second antenna module 60. The spacing H is preferred to be adjusted within a range between 0.1 mm and 10 mm to obtain the desired impedance matching.

As can be known from the above description, by means of the first antenna module 40 and the second antenna module 60, the antenna device 2 can provide at least two resonance modes each comprising multiple frequencies to satisfy the need for dual modes and multiple frequencies.

Figure 5:
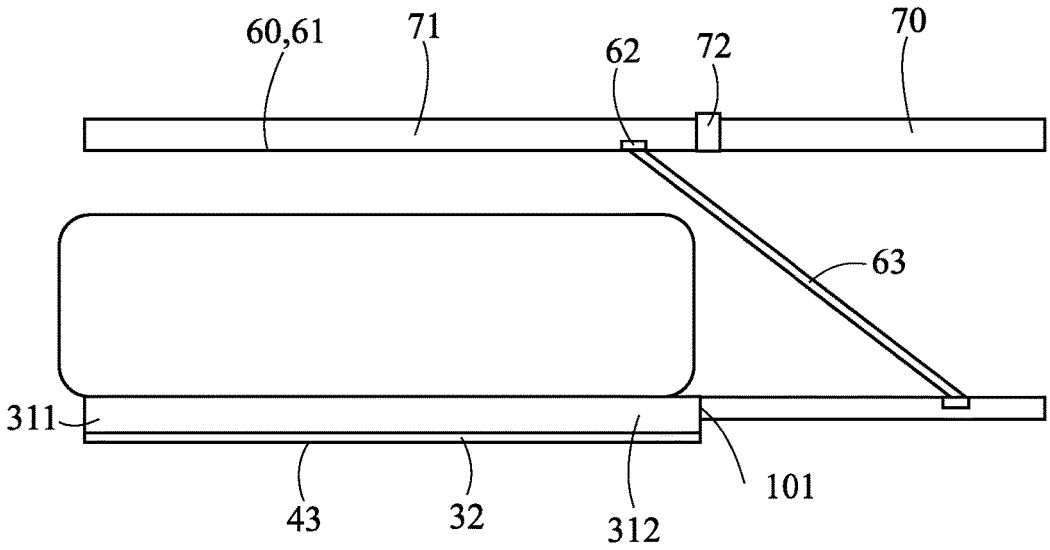
FIG. 5 is another side view of the antenna device according to the second preferred embodiment of the present invention.

The antenna device 2 may further comprise a cover 70 (as shown in FIG. 5) disposed above the circuit board 10 and the carrier 31. The cover 70 may be a back cover of the electronic product, and comprises a metal portion 71 and an insulated portion 72. The metal portion 72 is located directly above the carrier 31. The second radiator 61 may comprise at least a part of the metal portion 71 to additionally save the space for accommodating the second radiator 61; in other words, the second antenna module 60 uses the pre-existing metal portion 71 of the cover 70 as a radiator for transceiving electromagnetic waves.

It is further noted that the metal portion 71 shall not be much larger than the desired radiation path L2, otherwise it would be difficult to adjust the radiation path L2 to the desired value. Additionally, if the cover 70 does not comprise a metal portion, then the second radiator 61 may be a metal conductor embedded in the cover 70, in which case the second radiator 61 will not additionally occupy the internal space of the electronic product.

Figure 3A:
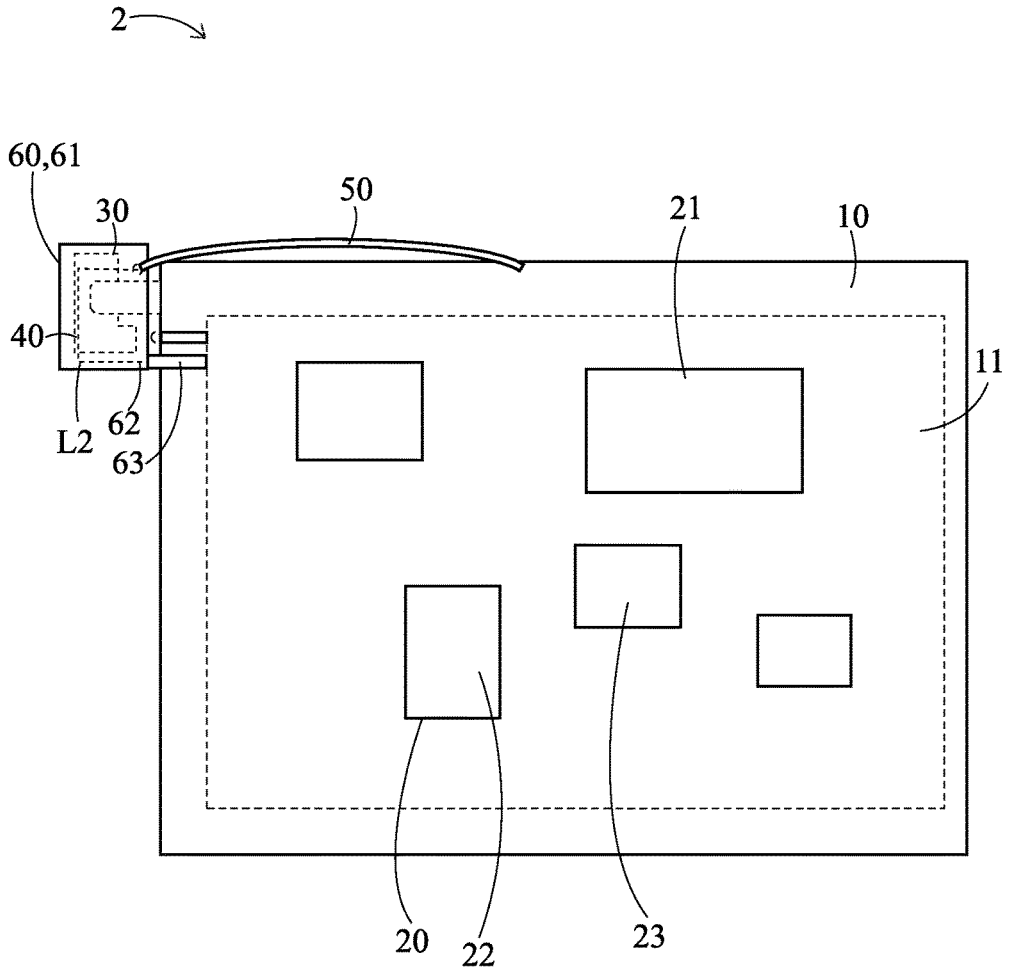
FIG. 3A is a top view of an antenna device according to the second preferred embodiment of the present invention.
Figure 3B:
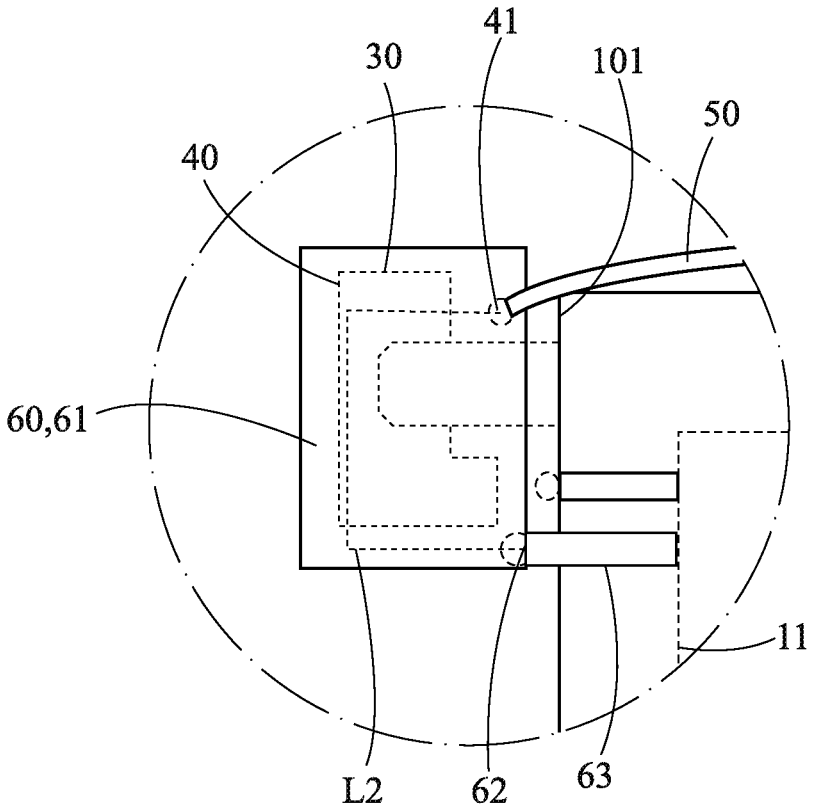
FIG. 3B is a partially enlarged view of FIG. 3A.
Figure 4:
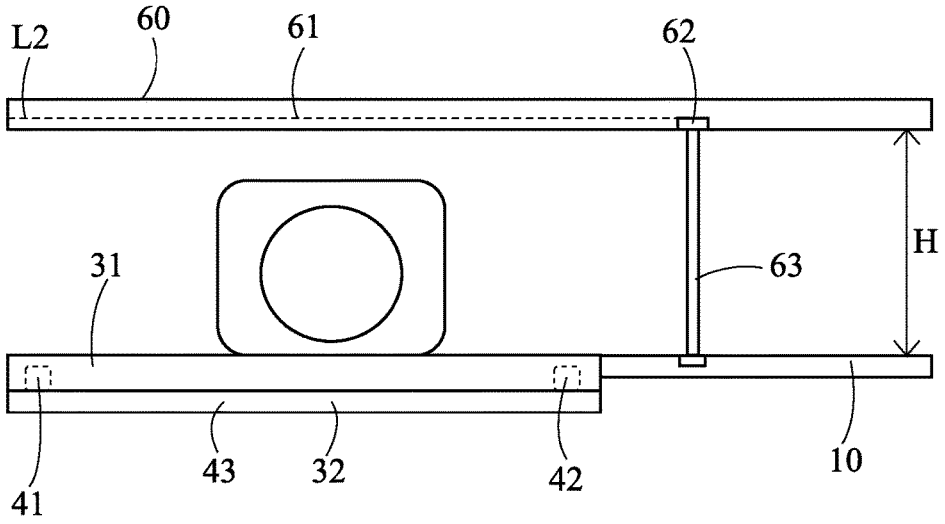
FIG. 4 is a side view of the antenna device according to the second preferred embodiment of the present invention.
Figure 6A:
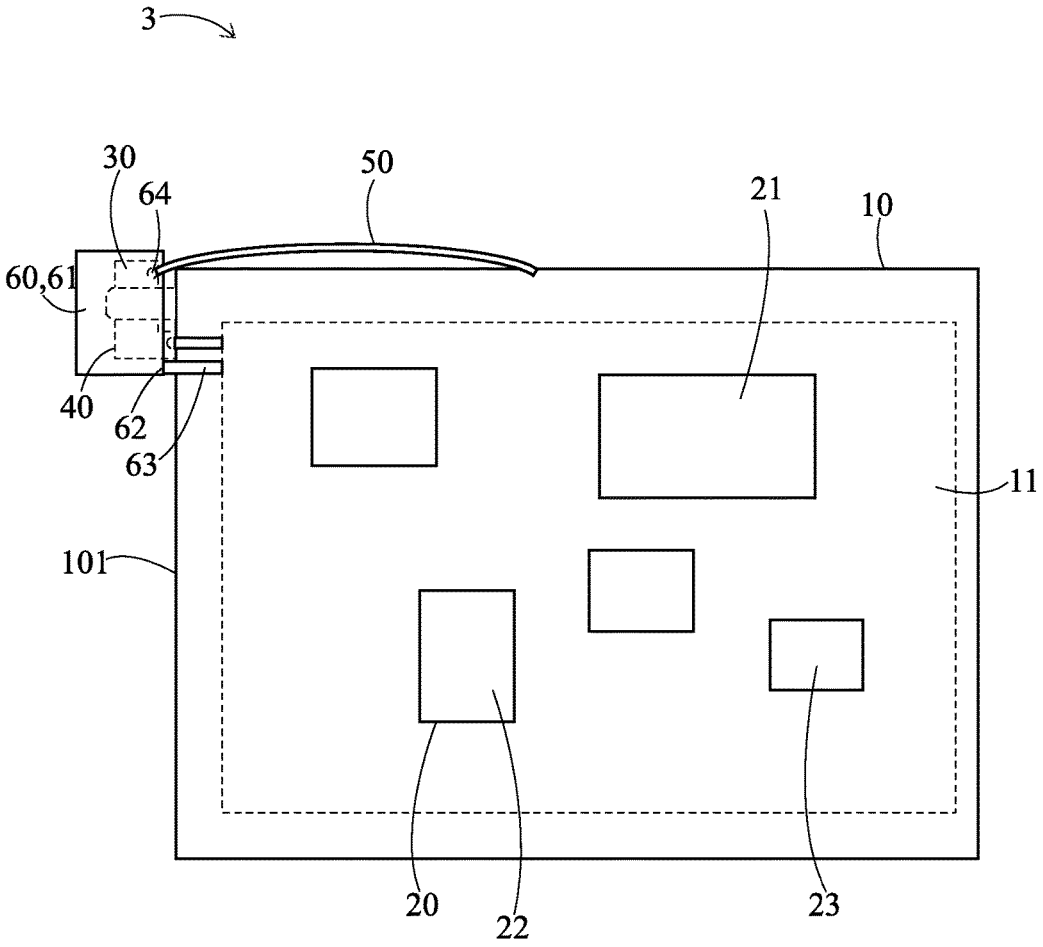
FIG. 6A is a top view of an antenna device according to the third preferred embodiment of the present invention.
Figure 6B:
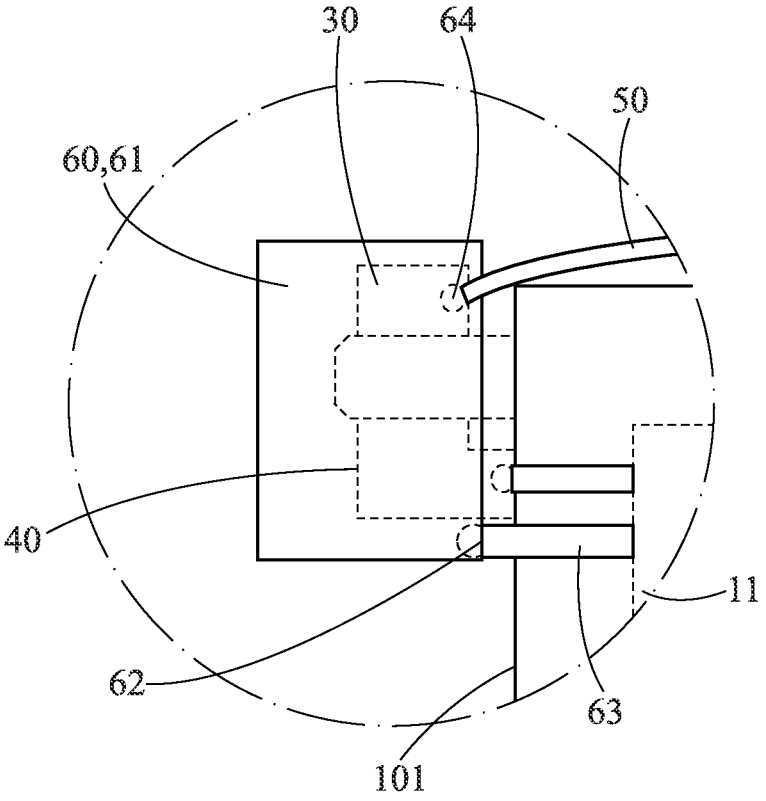
FIG. 6B is a partially enlarged view of FIG. 6A.
Figure 7:
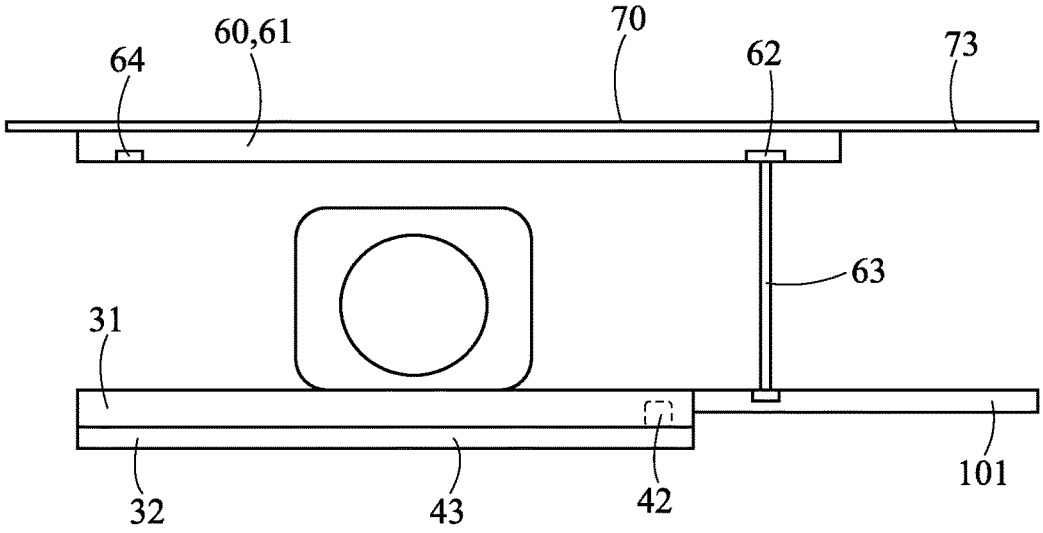
FIG. 7 is a side view of the antenna device according to the third preferred embodiment of the present invention.

FIGS. 6A, 6B and 7 show top views and a side view of an antenna device according to the third preferred embodiment of the present invention respectively. Similar to the antenna device 2 (as shown in FIG. 3A), the antenna device 3 may also comprise a circuit board 10, electronic components 20, a functional component module 30, a first antenna module 40, a feed line 50 and a second antenna module 60. However, the first antenna module 40 of the antenna device 3 does not comprise a feed point 41 (as shown in FIG. 3A) for direct connection with the feed line 50, and instead, the second antenna module 60 has a feed point 64 disposed at the end of the second radiator 61 that is opposite to the second ground point 62. The feed line 50 is electrically connected to the feed point 64 of the second antenna module 60.

Thus, the first wireless signal from the wireless communication chip 22 is transmitted to the feed point 64 and the second radiator 61 via the feed line 50 and the first wireless signal is then coupled to the first radiator 43 so that a resonance mode is excited in the first radiator 43. The second wireless signal from the wireless communication chip 22 is transmitted to the feed point 64 via the feed line 50 to feed into the second radiator 61 so that another resonance mode is excited in the second radiator 61.

On the other hand, the second radiator 61 may be disposed on the bottom surface 73 (as shown in FIG. 7) of the cover 70 so that the distance between the second radiator 61 and the carrier 31 (the first antenna module 40) is reduced to adjust the impedance matching of the first antenna module 40. In this case, the cover 70 may also not comprise a metal portion. The second radiator 61 is disposed on the bottom surface 73 through printing or adhesion or by means of a fixing part (e.g., a rivet or a bolt).

As can be known from the above descriptions, like the antenna device 2, the antenna device 3 can also satisfy the need for dual modes and multiple frequencies. Therefore, both the antenna devices 2 and 3 are applicable to the carrier aggregation and can be used as diversity antennas. In an actual test example where the antenna devices 2 and 3 are applied to a mobile phone with the following dimensions, 144.6 mm×69.7 mm×9.61 mm), the functional component module 30 is 13 mm×18 mm×7 mm, the spacing W is 1.5 mm and the spacing H is 6 mm. A graph of frequencies (MHz) versus voltage standing-wave ratios (VSWR) of the antenna devices 2, 3 are as shown in FIG. 8, and relationships between the frequencies (MHz) and the efficiency (%) of the antenna devices 2 and 3 are as shown in the following table.

| | | | | | | | | | |
|---|---|---|---|---|---|---|---|---|---|
| Frequency | 1710.2 | 1755 | 1805.2 | 1850.2 | 1880 | 1909.8 | 1930.2 | 1960 | 1989.8 |
| Efficiency | 9.54 | 9.01 | 12.31 | 17.84 | 19.79 | 20.42 | 23.17 | 25.38 | 24.01 |
| Frequency | 2010 | 2025 | 2110 | 2140 | 2167.6 | 2300.8 | 2350 | 2399.2 | 2500 |
| Efficiency | 20.83 | 20.02 | 22.08 | 19.82 | 19.26 | 24.24 | 28.87 | 30.34 | 35.96 |
| Frequency | 2540 | 2580 | 2610 | 2650 | 2690 | * | * | * | * |
| Efficiency | 34.06 | 37.11 | 40.41 | 48.08 | 46.53 | * | * | * | * |

Figure 8:
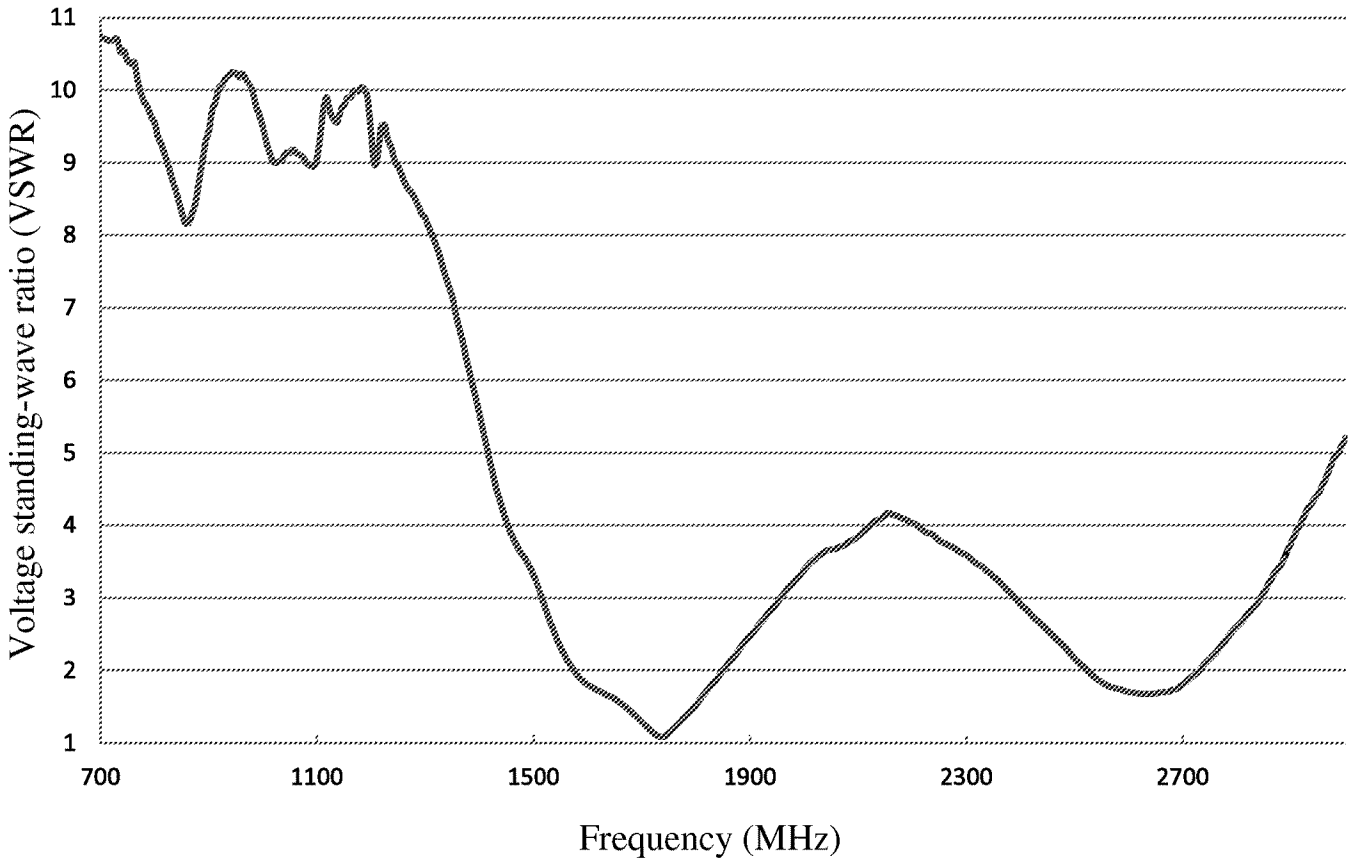
FIG. 8 is a graph of frequencies versus voltage standing-wave ratios (VSWRs) of the antenna devices according to the second and the third preferred embodiments of the present invention.

As can be seen from FIG. 8 and this table, the VSWR values are less than 4.05 and the efficiency is higher than 12% throughout the intermediate frequency band and the high frequency band from 1805 MHz to 2700 MHz. This indicates that the antenna devices 2 and 3 produce desirable VSWRs and efficiency within these frequency bands, and conform to the requirements of LTE (Long-Term Evolution) bands B3, B2, B1, B4, B25, B38, B39, B40, B41, B7 and Wi-Fi 2.4G Accordingly, the antenna devices proposed in the embodiments of the present invention integrate the antenna module and pre-existing functional components to conserve space occupied by the antenna module and to reduce the clearance region necessary for the antenna module. Furthermore, the antenna devices provide at least two resonance modes and multiple operation frequencies to satisfy the need of modern wireless communications.

The above disclosure is related to the detailed technical contents and inventive features thereof. People skilled in this field may proceed with a variety of modifications and replacements based on the disclosures and suggestions of the invention as described without departing from the characteristics thereof. Nevertheless, although such modifications and replacements are not fully disclosed in the above descriptions, they have substantially been covered in the following claims as appended.

What is claimed is:

1. An antenna device, comprising:

a circuit board, comprising a ground layer;

a plurality of electronic components, being disposed on the circuit board and including a microprocessor and a wireless communication chip;

a functional component module comprising a carrier and a metal member disposed on the carrier, the carrier having a main portion and an extended portion, a side surface of the main portion being spaced apart from and facing toward a side surface of the circuit board, and the extended portion extending integrally from the side surface of the main portion to connect with the side surface of the circuit board;

a first antenna module, having a feed point, a first ground point and a first radiator, the feed point being disposed on the main portion and electrically connected to a side of the metal member, the first ground point being disposed on the extended portion and electrically connected to the other side of the metal member and electrically connected to the ground layer, and the first radiator comprising at least a part of the metal member, wherein, the feed point and the first ground point are disposed on two opposite sides of the first radiator, respectively; and a feed line, having one end electrically connected to the feed point and another end electrically connected to the wireless communication chip, and being configured to transmit a first wireless signal to the feed point to feed into the first radiator;

wherein a radiation path of the first antenna module is defined from the feed point disposed on the main portion through the first radiator to the first ground point disposed on the extended portion.

2. The antenna device of claim 1, wherein the functional component module includes an earphone module, a camera module, a speaker module, a vibration module or a connector module, and the metal member includes a metal enclosure, a metal pin, a metal sheet, a metal line, a resistor, a capacitor or an inductor.

3. The antenna device of claim 1, wherein the side surface of the main portion has a distance of 0.5 mm to 5 mm from the side surface of the circuit board.

4. The antenna device of claim 1, wherein the extended portion and the circuit board are integrally formed.

5. The antenna device of claim 1, further comprising a second antenna module that is disposed above the carrier and has a second radiator and a second ground point, wherein the second ground point is disposed at an end of the second radiator and electrically connected to the ground layer; and the feed line is further configured to transmit a second wireless signal to the feed point so as to be coupled to the second radiator.

6. The antenna device of claim 5, further comprising a cover disposed above the circuit board and the carrier, wherein the second radiator comprises a metal portion of the cover.

7. The antenna device of claim 5, further comprising a cover disposed above the circuit board and the carrier, wherein the second radiator is disposed on a bottom surface of the cover or is embedded within the cover.

8. The antenna device of claim 5, wherein the second antenna module further comprises a connecting part electrically connecting the second ground point and the ground layer.

9. The antenna device of claim 8, wherein the connecting part comprises an elastic sheet, a transmission line or a pogo pin.

10. The antenna device of claim 5, wherein the second antenna module has a distance of 0.1 mm to 10 mm from the carrier.

11. An antenna device, comprising:

a circuit board, comprising a ground layer;

a plurality of electronic components, being disposed on the circuit board and including a microprocessor and a wireless communication chip;

a functional component module comprising a carrier and a metal member disposed on the carrier, the carrier having a main portion and an extended portion, a side surface of the main portion being spaced apart from and facing toward a side surface of the circuit board, and the extended portion extending integrally from the side surface of the main portion to connect with the side surface of the circuit board;

a first antenna module, having a first ground point and a first radiator, the first ground point being disposed on the extended portion and electrically connected to one side of the metal member and electrically connected to the ground layer, and the first radiator comprising at least a part of the metal member;

a second antenna module, being disposed above the carrier and having a feed point, a second radiator and a second ground point, the feed point being disposed at one end of the second radiator, and the second ground point being disposed at another end of the second radiator and electrically connected to the ground layer; and a feed line, having one end electrically connected to the feed point and another end electrically connected to the wireless communication chip, and being configured to transmit a first wireless signal to the feed point so as to be coupled to the first radiator and transmit a second wireless signal to the feed point to feed into the second radiator.

12. The antenna device of claim 11, wherein the functional component module includes an earphone module, a camera module, a speaker module or a connector module, and the metal member includes a metal enclosure, a metal pin, a metal sheet, a metal line, a resistor, a capacitor or an inductor.

13. The antenna device of claim 11, wherein the side surface of the main portion has a distance of 0.5 mm to 5 mm from the side surface of the circuit board.

14. The antenna device of claim 11, further comprising a cover disposed above the circuit board and the carrier, wherein the second radiator comprises a metal portion of the cover.

15. The antenna device of claim 11, further comprising a cover disposed above the circuit board and the carrier, wherein the second radiator is disposed on a bottom surface of the cover or is embedded within the cover.

16. The antenna device of claim 11, wherein the second antenna module further comprises a connecting part electrically connecting the second ground point and the ground layer.

17. The antenna device of claim 16, wherein the connecting part comprises an elastic sheet, a transmission line or a pogo pin.

18. The antenna device of claim 11, wherein the second antenna module has a distance of 0.1 mm to 10 mm from the carrier.

19. The antenna device of claim 11, wherein the extended portion and the circuit board are integrally formed.

* * * * *